US007501029B2

(12) United States Patent
Suzaki et al.

(10) Patent No.: US 7,501,029 B2
(45) Date of Patent: Mar. 10, 2009

(54) HIGH-STRENGTH, HIGH-PERMEABILITY STEEL SHEET FOR PICTURE TUBE BAND AND METHOD OF PRODUCING THE SAME

(75) Inventors: Tsunetoshi Suzaki, Kure (JP); Kentaro Hirata, Kure (JP); Yuichi Higo, Kure (JP)

(73) Assignee: Nisshin Steel Co., Ltd., Tokyo (JP)

( * ) Notice: Subject to any disclaimer, the term of this patent is extended or adjusted under 35 U.S.C. 154(b) by 388 days.

(21) Appl. No.: 10/552,350

(22) PCT Filed: Apr. 12, 2004

(86) PCT No.: PCT/JP2004/005207

§ 371 (c)(1), (2), (4) Date: Oct. 7, 2005

(87) PCT Pub. No.: WO2004/092433

PCT Pub. Date: Oct. 28, 2004

(65) Prior Publication Data

US 2006/0134452 A1 Jun. 22, 2006

(30) Foreign Application Priority Data

Apr. 15, 2003 (JP) ..... 2003-110771

(51) Int. Cl.
*H01F 1/147* (2006.01)

(52) U.S. Cl. ..... 148/307; 420/8; 148/111; 148/120

(58) Field of Classification Search ..... None
See application file for complete search history.

(56) References Cited

U.S. PATENT DOCUMENTS 6,129,992 A * 10/2000 Sakuma et al. ..... 428/611
2005/0167006 A1* 8/2005 Mineji et al. ..... 148/307

FOREIGN PATENT DOCUMENTS

| | | |
|---|---|---|
| JP | 10-208670 | 8/1998 |
| JP | 10-214578 | 8/1998 |
| JP | 11-140601 | 5/1999 |
| JP | 11-293397 | 10/1999 |
| JP | 2000-038644 | 2/2000 |
| JP | 2000-290759 | 10/2000 |
| JP | 2002-290759 | 10/2000 |
| JP | 2001-040417 | 2/2001 |
| JP | 2001-040418 | 2/2001 |
| JP | 2001-040419 | 2/2001 |
| JP | 2001-040420 | 2/2001 |
| JP | 2002-012956 | 1/2002 |

OTHER PUBLICATIONS

English Language Translation of Japanese Patent Document No. 11-140601.*

* cited by examiner

*Primary Examiner*—John P. Sheehan
(74) *Attorney, Agent, or Firm*—Clark & Brody

(57) ABSTRACT

A high-strength, high-permeability steel sheet for picture tube band comprises, in mass percent, C: 0.003-0.010%, Si: 0.5-1.0%, Mn: 1.0-2.0%, P: 0.04-0.15%, S: not more than 0.02%, Al: not more than 0.030%, N: not more than 0.004% and the balance of Fe and unavoidable impurities, has a chemical composition satisfying $C \times Mn \times P \geqq 2.5 \times 10^{-4}$, and has a ferrite crystal grain diameter of 10-100 μm and a yield stress of 300 $N/mm^2$ or higher, and preferably has a specific permeability μ0.35 in a DC magnetic field of 0.35 Oe of 400 or higher. The steel sheet can be produced by regulating the hot-rolling coiling temperature to 600-700° C. and selecting an appropriate combination of the cold rolling reduction ratio and a final annealing temperature in the range of 750-900° C.

10 Claims, No Drawings

HIGH-STRENGTH, HIGH-PERMEABILITY STEEL SHEET FOR PICTURE TUBE BAND AND METHOD OF PRODUCING THE SAME

TECHNICAL FIELD

This invention relates to a high-strength steel sheet excellent in geomagnetic shielding property for use in a picture tube band for clamping the periphery of the panel portion of a cathode ray tube (another named to Braun tube or picture tube) incorporated in a television set, office automation machine or the like.

BACKGROUND ART

Since the interior of a picture tube is maintained in a high-vacuum state, the outer periphery of the panel is clamped with a steel band for preventing concave deformation and/or implosion of the front panel and for preventing scattering of the panel glass at the time of implosion. A soft-magnetic, high-strength plated steel sheet of a thickness of about 0.8-2.0 mm is used for the picture tube band. At the time of clamping, the picture tube band is processed into a prescribed shape, thermally expanded by heating to around 450-550° C., fitted on the periphery of the panel portion, and immediately subjected to rapid cooling to implement the shrinkage fitting method to obtain a strong clamping force by the firm fastening of the band. This clamping force precisely corrects the shape of the panel face that was concavely deformed owing to the high-vacuum inside the tube. In addition, the soft magnetic property of the band enables it to serve as a "magnetic shielding material against geomagnetism" that prevents invasion of geomagnetism into the interior of the picture tube. The picture tube band material is therefore required to have high strength and high permeability in a weak DC magnetic field on the order of geomagnetism. In particular, the high-strength property is preferably such as that a yield stress of 300 N/mm$^2$ or greater can be obtained with good stability.

Generally speaking, increasing steel strength and increasing steel permeability are incompatible objectives. For example, although effective methods for enhancing the strength of steel sheet include precipitation strengthening by addition of Ti, Nb or the like, strengthening by ferrite crystal grain refinement, dislocation strengthening by imparting working strain and the like, all of these strengthening measures lower permeability. Various picture tube band steels have been developed heretofore with the aim of achieving these incompatible properties. For example, those taught in the following Patent Documents are known:

Patent Document 1 JP. Hei-10-208670A
Patent Document 2 JP. Hei-10-214578A
Patent Document 3 JP. Hei-11-140601A
Patent Document 4 JP. Hei-11-293397A
Patent Document 5 JP. 2000-290759A
Patent Document 6 JP. 2001-040417A
Patent Document 7 JP. 2001-040418A
Patent Document 8 JP. 2001-040419A
Patent Document 9 JP. 2001-040420A Patent Documents 1 and 2 teach methods of producing a picture tube band using a so-called "silicon steel sheet," namely, a cold-rolled steel sheet added with not less than 1% Si and having a C content of not greater than 0.005%. However, the material property required for geomagnetic shielding property improvement is permeability in a weak DC magnetic field and there is no need for the low iron loss in an alternating magnetic field that characterizes silicon steel sheet. Moreover, addition of a large amount of Si to a steel after it has once been reduced to a very low carbon content of C≦0.005% increases cost and also markedly degrades the toughness and ductility of the steel to lower productivity owing to increased susceptibility to cracking during hot rolling and cold rolling. In addition, the so-called temper color that tends to arise during annealing owing to oxidation of Si in the surface layer degrades the plating adherence property.

Patent Document 3 teaches utilization of a Ti-added steel. However, the high recrystallization temperature of a Ti-added steel increases production cost. Moreover, permeability is degraded owing to the fact that fine precipitated carbonitride directly prevents migration of magnetic domain walls and that the ferrite crystal grain diameter is reduced.

Patent Document 4 teaches a steel whose strength is increased by P addition and positive utilization of strain produced by temper rolling and whose low magnetic field property is enhanced by controlling the balance between the crystal grain diameter and the temper rolling. Patent Document 5 teaches improvement of magnetic properties and steel strengthening that is based on carrying out addition of Si and Mn. Patent Documents 6 to 9 teach utilization of age-hardening by solid solution C for strength enhancement and simultaneous achievement of high strength and high permeability without need for extreme carbon reduction or heavy Si addition, by controlling cementite precipitation morphology/size and ferrite crystal grain diameter. In studies conducted by the inventors, however, it was found that these disclosed methods do not necessarily make it possible to realize high yield stress of 300 N/mm$^2$ or higher with good stability.

OBJECT OF THE INVENTION

The object of the present invention is to provide a technology particularly for enabling stable achievement of high yield stress of 300 N/mm$^2$ or higher with good stability in a steel sheet for picture tube band which is to be made high in strength and permeability without heavy addition of Si or utilization of Ti or other precipitation strengthening elements.

DISCLOSURE OF THE INVENTION

Through an in-depth study regarding methods for achieving consistent strength enhancement without magnetic property degradation, the inventors discovered that use of Mn and P solid-solution strengthening as the steel strengthening mechanism is highly effective. In addition, appropriate incorporation of C and Si enables further strength enhancement and also makes it possible to avoid cost increase owing to extreme C content reduction and degradation of plating adherence property by high Si content. It was further ascertained that strict control of ferrite crystal grain diameter enables achievement of stable high strength without hindering realization of high permeability. The present invention was accomplished based on this knowledge.

Specifically, the present invention provides a high-strength, high-permeability steel sheet for picture tube band having a chemical composition comprising, in mass percent, C: 0.003-0.010%, Si: 0.5-1.0%, Mn: 1.0-2.0%, P: 0.04-0.15%, S: not more than 0.02%, Al: not more than 0.030%, N: not more than 0.004% and the balance of Fe and unavoidable impurities, and having a ferrite crystal grain diameter of 10-100 μm and a yield stress of 300 N/mm$^2$ or higher. By "ferrite crystal grain diameter" is meant average grain diameter. From this it follows that the ferrite structure may include crystal grains of diameters smaller than 10 μm and larger than 100 μm.

The present invention further provides a high-strength, high-permeability steel sheet for picture tube band comprising, in mass percent, C: 0.003-0.010%, Si: 0.5-1.0%, Mn: 1.0-2.0%, P: 0.04-0.15%, S: not more than 0.02%, Al: not more than 0.030%, N: not more than 0.004% and the balance of Fe and unavoidable impurities, having a chemical composition satisfying the following Equation 1, and having a ferrite crystal grain diameter of 10-100 μm and a yield stress of 300 $N/mm^2$ or higher:

$$C \times Mn \times P \geqq 2.5 \times 10^{-4} \quad (1).$$

On the left side of Equation (1), the terms C, Mn and P are to be replaced by values representing the C, Mn and P contents expressed in mass percent.

The aforesaid steel sheets can have a C content of greater than 0.005% to 0.010% and exhibit a specific permeability μ0.35 in a DC magnetic field of 0.35 Oe (oersted) of 400 or higher. Further, the aforesaid steel sheets can have a Zn-system or Al-system plating layer on the surface thereof. By "Zn-system plating" is meant a plating layer whose composition consists of not less than 50 mass % of Zn and, similarly, by "Al-system plating" is meant a plating layer whose composition consists of not less than 50 mass % of Al.

Further, the present invention provides a method of producing an aforesaid steel sheet characterized in that when production is carried out by, after hot rolling, conducting one or a plurality of cold rolling and annealing runs, (1) a coiling temperature after hot rolling is made 600-700° C., and (2) a "final cold rolling reduction ratio" and a "final annealing temperature" in a range of 750-900° C. are combined in accordance with a recrystallization property of the steel so that the ferrite crystal grain diameter after final annealing becomes 10-100 μm.

In the case of a production process in which a single cold rolling and annealing run is conducted, "final cold rolling reduction ratio" and "final annealing temperature" mean the cold rolling reduction ratio and annealing temperature in the run, and in the case of a production process in which a plurality of cold rolling and annealing runs are conducted, mean the cold rolling reduction ratio and annealing temperature in the final run. By "recrystallization property of the steel" is meant a relationship, determined beforehand for the steel to be produced, that defines how the cold rolling reduction ratio and annealing temperature are related to post-annealing crystal grain diameter.

Plating can be conducted after the final annealing of the production method. At such time, either of the following processes (a) and (b) can be adopted:

(a) Production process of, after hot rolling, conducting one or a plurality of cold rolling and annealing runs and conducting Z-system or Al-system hot-dip plating inline in the cooling step of the final annealing run.

(b) Production process of, after hot rolling, conducting one or a plurality of cold rolling and annealing runs, conducting Z-system or Al-system hot-dip plating inline in the cooling step of the final annealing run, and thereafter conducting temper rolling of not greater than 1.5%.

When hot-dip plating is conducted inline, immersion in a hot-dip plating bath is conducted subsequent to the final annealing. It is therefore conducted so that the ferrite crystal grain diameter after plating becomes 10-100 μm.

In addition, the following processes (c)-(f) can be adopted after the final annealing of the production method:

(c) Production process of, after hot rolling, conducting one or a plurality of cold rolling and annealing runs and then conducting temper rolling at not greater than 1.5%.

(d) Production process of, after hot rolling, conducting one or a plurality of cold rolling and annealing runs and thereafter conducting Zn-system electroplating.

(e) Production process of, after hot rolling, conducting one or a plurality of cold rolling and annealing runs, then conducting temper rolling at not greater than 1.5% and thereafter conducting Zn-system electroplating.

(f) Production process of, after hot rolling, conducting one or a plurality of cold rolling and annealing runs, thereafter conducting Zn-system electroplating, and further conducting temper rolling at not greater than 1.5%.

PREFERRED EMBODIMENTS OF THE INVENTION

In the high-strength, high-permeability steel sheet for picture tube band according the present invention, C is effective for increasing the strength of the steel. When the C content is less than 0.003 mass %, sufficient strengthening performance cannot be obtained and such a reduced C steel is undesirable in the present invention because it needlessly makes the steel-making more difficult. On the other hand, a C content exceeding 0.010 mass % poses a problem of magnetic property degradation. The present invention therefore defines C content as 0.003-0.010 mass %. The particularly preferable C content range is more than 0.005 to 0.010 mass %.

Si contributes high strength enhancement as a solid solution strengthening element. A content of not less than 0.5 mass % is required to take full advantage of this effect. However, an upper limit of 1.0 mass % is set because a large Si content degrades workability and plating adherence property.

Mn contributes to high strength enhancement as a solid solution strengthening element and is more advantageous than Si addition from the viewpoint of plating adherence property. In the present invention, therefore, not less than 1.0 mass % of Mn is added to take positive advantage of its strengthening action. Caution is required, however, because at a content exceeding 2.0 mass % workability deteriorates and plating adherence property also declines.

Although P contributes to high strength enhancement as a solid solution strengthening element, it segregates at the grain boundaries in the steel to cause harmful effects, namely, degradation of productivity and steel toughness. Studies showed that the contribution to high strength enhancement commences at a content of about 0.04 mass % and that these harmful effects do not become a substantial problem insofar as the content is not greater than 0.15 mass %. The present invention therefore promotes high strength enhancement by positive inclusion of P within the range of 0.04-0.15 mass %.

S is present in the steel as an inclusion and is required to be reduced to 0.02 mass % or less because it degrades bending workability and magnetic properties.

Al can be added as a deoxidizing agent as occasion demands. However, it is added within the content range of not greater than 0.030 mass % because formation of a large amount of AlN in the steel degrades the magnetic properties.

N is present in the steel sheet in the form of precipitants such as AlN. In the present invention, N should be reduced to a content of 0.004 mass % or less because it degrades magnetic properties.

In order to realize a picture tube having a flattened front glass and "anti-implosion property," the periphery of the glass must be strongly clamped by a band material fitted by the shrinkage fitting method. The band material therefore requires high yield stress. Of particular note is that the "anti-implosion property" of the glass itself has been declining in recent years owing to trend toward thinner walls, which has made it necessary for the band material to bear proportionally higher stress. Moreover, a need to decrease the thickness of the band material itself can also be expected to arise, and this will make the stress level that must be borne still higher. Taking these points into account, future picture tube band materials should preferably have at least the capability of a yield stress of not less than 300 $N/mm^2$.

In the present invention, on top of restricting the contents of the different elements of the steel to within the aforesaid ranges, it is particularly preferable to incorporate C, Mn and P so as to satisfy the following Equation 1:

$$C \times Mn \times P \geqq 2.5 \times 10^{-4} \quad (1).$$

In a steel sheet whose chemical composition satisfies this relationship, a high yield stress of 300 $N/mm^2$ can be consistently achieved by regulating the crystal grain diameter as explained below. It is worth noting that is still more preferable to satisfy $C \times Mn \times P \geqq 3.0 \times 10^{-4}$.

When used as a picture tube band, the steel sheet of the present invention is substantially to exhibit a ferrite single phase structure. It is known that enlargement of crystal grain diameter is generally effective for improving the permeability thereof. On the other hand, it is known that smaller crystal grain diameter is generally advantageous for enhancing the strength of the steel. It is therefore essential to regulate the crystal grain diameter to satisfy both the magnetic property requirement and the strength requirement. With regard to magnetic property, shielding effect against geomagnetism is adequate when using a band material characterized in that its "specific permeability μ0.35" in a DC magnetic field of 0.35 Oe is 400 or higher. As pointed out earlier regarding strength, a yield stress of not less than 300 $N/mm^2$ is necessary. Through an in-depth study of the steel sheet having the aforesaid composition, the inventors discovered that these property requirements are satisfied when the ferrite crystal grain diameter is regulated to within the range of 10-100 μm. Specifically, μ0.35 can be made 400 or higher by making the ferrite crystal grain diameter not less than 10 μm and a yield stress of not less than 300 $N/mm^2$ can be realized by making it not greater than 100 μm. The lower limit of the ferrite crystal grain diameter is more preferably 15 μm.

As explained later, the crystal grain diameter can be controlled by regulating the coiling temperature after hot rolling and selecting an appropriate combination of the cold rolling reduction ratio and final annealing temperature.

The steel sheet of the present invention is preferably used as applied with a Zn-system or Al-system plating. The plating method is not particularly limited. Insofar as the aforesaid crystal grain diameter can be finally obtained, either hot-dip plating or electroplating can be utilized. For example, the hot-dip plating adopted can be Zn plating, Al plating, Zn—4 to 13% Al—1 to 4% Mg plating or the like, while the electroplating can be Zn plating, Al plating, Zn—10 to 16% Ni plating or the like.

An ordinary steel sheet production line can be used to produce the steel sheet of the present invention. No special processes are required. Specifically, production is possible by a process of, following steelmaking, conducting hot rolling, cold rolling and annealing, and as occasion demands, further conducting temper rolling. The cold rolling and annealing can be conducted once in a single run or repeatedly in a plurality of runs depending on the desired sheet thickness.

However, the production conditions need to be designed so as to control the ferrite crystal grain diameter to within the range of 10-100 μM.

First, it is necessary to make the coiling temperature after hot rolling 600° C. or higher. This is for allowing AlN precipitation to proceed thoroughly beforehand during coiling so as to grow the AlN particles. This makes it possible to suppress precipitation of fine AlN, which would impede recrystallized crystal grain growth during annealing in a later processing step, thereby enabling control of the crystal grain diameter. When the coiling temperature is under 600° C., AlN precipitation and growth is insufficient during coiling so that precipitation of fine crystal grain occurs during annealing. In such a case, no improvement in magnetic properties is realized. On the other hand, when the coiling temperature exceeds 700° C., the scale thickness of the hot-rolled sheet increases to noticeably degrade the surface condition. In the present invention, therefore, the coiling temperature after hot rolling is defined as 600-700° C.

Thus in the present invention, AlN is allowed to precipitate and grow thoroughly in advance. Once it has, the final ferrite crystal grain diameter is controlled to within the range of 10-100 μm by selecting an appropriate combination of the final cold rolling "reduction ratio" and the final annealing "temperature." The final cold rolling reduction ratio is preferably made 10% or higher so that recrystallization readily occurs during the ensuing annealing. The final annealing is in the range of 750-900° C. At lower than 750° C., the recrystallization may not be altogether complete, while at higher than 900° C., the effect of the recrystallization saturates, resulting in a needless increase in cost. The hot holding time in final annealing need not be specifically defined but is preferably about 15-120 seconds.

The appropriate combination of final cold rolling reduction ratio and final annealing temperature can be easily found by experimentally determining how the cold rolling reduction ratio and annealing temperature affect the post-annealing crystal grain diameter and, for instance, graphing the results.

When hot-dip Zn-system plating or hot-dip Al-system plating is carried out, an integrated continuous line incorporating the annealing equipment and plating equipment can be utilized to conduct "inline plating." In this case, it is necessary for the annealing immediately before the plating to be the "final annealing" defined by the present invention. In other words, the method adopted can be that of conducting the final annealing at an appropriate temperature in the range of 750-900° C. in the annealing equipment of a continuous hot-dip line and carrying out plating by immersing the steel sheet in a hot-dip plating bath in the cooling step of the annealing. When Zn-system electroplating is applied, it is ordinarily conducted in a separate line following the final annealing. The electroplating can be carried out after the temper rolling described below or can be carried out prior to the temper rolling.

Application of temper rolling is effective for correcting the shape of the sheet. However, the temper rolling reduction ratio should be not greater than 1.5% because imparting excessive strain degrades the magnetic properties. A temper rolling reduction ratio of not greater than 1.5% can be considered to cause no substantial difference in the ferrite crystal grain diameter between before and after the temper rolling.

EXAMPLE

Effect of Steel Composition

Slabs of the chemical compositions shown in Table 1 were each hot-rolled to a thickness of 2.3 mm under conditions of a hot-rolling finishing temperature of 920° C. and a coiling temperature of 650° C. and the hot-rolled sheet was cold rolled to a thickness of 1.2 mm. Continuous annealing (final annealing) was then conducted at 850° C. Temper rolling was not applied.

TABLE 1

| Steel No. | (mass %) C | Si | Mn | P | S | Al | N | C × Mn × P × $10^{-4}$ | |
|---|---|---|---|---|---|---|---|---|---|
| 1 | 0.0052 | 0.70 | 1.21 | 0.062 | 0.004 | 0.015 | 0.0020 | 3.90 | Invention |
| 2 | 0.0062 | 0.53 | 1.82 | 0.054 | 0.004 | 0.021 | 0.0032 | 6.09 | |
| 3 | 0.0048 | 0.65 | 1.45 | 0.120 | 0.006 | 0.012 | 0.0026 | 8.35 | |
| 4 | 0.0082 | 0.78 | 1.12 | 0.052 | 0.002 | 0.026 | 0.0016 | 4.78 | |
| 5 | 0.0054 | 0.92 | 1.52 | 0.102 | 0.003 | 0.018 | 0.0025 | 8.37 | |
| 6 | 0.0042 | 0.72 | 1.84 | 0.085 | 0.004 | 0.019 | 0.0026 | 6.57 | |
| 7 | 0.0055 | 0.55 | 1.42 | 0.065 | 0.011 | 0.022 | 0.0016 | 4.62 | |
| 8 | 0.0036 | 0.62 | 1.73 | 0.052 | 0.005 | 0.011 | 0.0036 | 3.33 | |
| 9 | 0.0072 | 0.90 | 1.23 | 0.112 | 0.006 | 0.012 | 0.0023 | 9.92 | |
| 10 | 0.0055 | 0.75 | 1.72 | 0.072 | 0.005 | 0.020 | 0.0028 | 6.81 | |
| 11 | 0.0046 | 0.78 | 1.53 | 0.088 | 0.004 | 0.023 | 0.0045* | 6.19 | Comparative |
| 12 | 0.0052 | 0.35* | 1.82 | 0.060 | 0.004 | 0.012 | 0.0024 | 5.68 | |
| 13 | 0.0062 | 0.62 | 0.85* | 0.065 | 0.007 | 0.023 | 0.0032 | 3.43 | |
| 14 | 0.0053 | 0.65 | 1.68 | 0.023* | 0.004 | 0.025 | 0.0025 | 2.05* | |
| 15 | 0.0125* | 0.62 | 1.35 | 0.103 | 0.003 | 0.016 | 0.0016 | 17.38 | |
| 16 | 0.0036 | 0.61 | 1.20 | 0.052 | 0.005 | 0.019 | 0.0033 | 2.25* | |

*Outside invention range

The annealed sheets were all substantially of ferrite single phase structure. The ferrite crystal grain diameter, yield stress and specific permeability μ0.35 in a DC magnetic field of 0.35 Oe were determined for each sheet Ferrite crystal grain diameter was measured with respect to a cross-section including the sheet rolling direction and thickness direction, using a cutting method in conformance with JIS G 0552.

Yield stress was determined from a stress-strain curve obtained by carrying out a tensile test using a JIS No. 5 tensile test specimen cut in the rolling direction.

μ0.35 was measured using a demagnetized ϕ33 mm×45 mm ring specimen to determine permeability in a magnetic field of 0.35 Oe.

The results are shown in Table 2.

TABLE 2

| Steel No. | Ferrite crystal grain diameter (μm) | Yield stress (N/mm$^2$) | Specific permeability μ0.35 | |
|---|---|---|---|---|
| 1 | 15 | 364 | 550 | Invention |
| 2 | 15 | 350 | 500 | |
| 3 | 20 | 360 | 530 | |
| 4 | 13 | 381 | 620 | |
| 5 | 16 | 398 | 560 | |
| 6 | 17 | 369 | 520 | |
| 7 | 16 | 347 | 580 | |
| 8 | 25 | 317 | 450 | |
| 9 | 13 | 417 | 500 | |
| 10 | 18 | 362 | 520 | |
| 11 | 15 | 385 | 320* | Comparative |
| 12 | 17 | 285* | 470 | |

TABLE 2-continued

| Steel No. | Ferrite crystal grain diameter (μm) | Yield stress (N/mm$^2$) | Specific permeability μ0.35 |
|---|---|---|---|
| 13 | 14 | 294* | 480 |
| 14 | 20 | 287* | 510 |
| 15 | 15 | 374 | 280* |
| 16 | 18 | 275* | 450 |

*Insufficient property

As can be seen from Table 2, the steels of the present invention had ferrite crystal grain diameters in the range of 10-100 μm, high yield stresses of greater than 300 N/mm$^2$ and high specific permeabilities μ0.35 of greater than 400. In contrast, comparative steels Nos. 11 and 15 were poor in specific permeability because of excessive N content and excessive C content, respectively. Steels Nos. 12-14 were low in yield stress because of too small content of the solid solution strengthening elements Si, Mn and P. Steel No. 16 was low in yield stress despite satisfying the prescribed element content ranges because the value of C×Mn×P was below $2.5\times10^{-4}$.

Effect of Production Conditions

Steels Nos. 1 and 5 of Table 1 were subjected to the production process of hot rolling→cold rolling→annealing→(temper rolling) under varying production conditions and the resulting products were examined for ferrite crystal grain diameter, yield stress and specific permeability μ0.35.

The results are shown in Table 3.

TABLE 3

| Steel No. | Test No. | Hot-rolling coiling temp. (° C.) | Cold rolling reduction ratio (%) | Annealing temperature (° C.) | Temper rolling reduction ratio (%) | Ferrite crystal grain diameter (μm) | Yield stress (N/mm$^2$) | Specific permeability μ0.35 | |
|---|---|---|---|---|---|---|---|---|---|
| 1 | 1 | 650 | 48 | 850 | 0 | 15 | 364 | 550 | Invention |
| | 2 | 650 | 30 | 850 | 0 | 32 | 342 | 720 | Invention |
| | 3 | 650 | 15 | 850 | 0 | 62 | 320 | 800 | Invention |
| | 4 | 650 | 12* | 850 | 0 | 120* | 287* | 920 | Comparative |
| | 5 | 650 | 15 | 850 | 0.3 | 62 | 325 | 460 | Invention |
| | 6 | 650 | 12* | 850 | 0.3 | 120* | 392* | 520 | Comparative |

TABLE 3-continued

| Steel No. | Test No. | Hot-rolling coiling temp. (° C.) | Cold rolling reduction ratio (%) | Annealing temperature (° C.) | Temper rolling reduction ratio (%) | Ferrite crystal grain diameter (μm) | Yield stress (N/mm$^2$) | Specific permeability μ0.35 | |
|---|---|---|---|---|---|---|---|---|---|
| 5 | 7 | 650 | 48 | 850 | 0 | 16 | 398 | 560 | Invention |
| | 8 | 650 | 48 | 850 | 0.3 | 16 | 401 | 450 | Invention |
| | 9 | 650 | 48 | 850 | 1.0 | 16 | 405 | 420 | Invention |
| | 10 | 650 | 48 | 850 | 2.0* | 16 | 420 | 350* | Comparative |
| | 11 | 550* | 48 | 850 | 0 | 9* | 412 | 370* | Comparative |

*Inappropriate condition or insufficient property

In the comparative example tests Nos. 4 and 6, the cold rolling reduction ratio was set too small (12%), and since this was inappropriate in combination with the annealing temperature, the ferrite crystal grain diameter enlarged to greater than 100 μm. The yield strength declined as a result. In test No. 10, the temper rolling reduction ratio was made greater than 1.5%, which increased internal strain and lowered the specific permeability μ0.35. In test No. 11, the coiling temperature after hot rolling was made lower than 600° C., which can be presumed to have caused precipitation of AlN in the ensuing annealing step, so that the specific permeability μ0.35 became low because a ferrite crystal grain diameter of 10 μm greater could not be obtained. In the invention examples, on the other hand, the coiling temperature, combination of cold rolling reduction ratio and annealing temperature, and temper rolling reduction ratio were appropriately selected, whereby the ferrite crystal grain diameter fell in the appropriate range and a high yield strength of not less than 300 N/mm$^2$ and a high specific permeability μ0.35 of not less than 400 were obtained.

Thus, the present invention enables production of a high-strength, high-permeability steel sheet that has excellent shielding property with respect to geomagnetism and stably exhibits a high yield stress of not less than 300 N/mm$^2$, by use of ordinary steel sheet production equipment and without addition of a large amount of Si or of Ti or other precipitation strengthening elements. The steel sheet of the present invention is therefore highly useful as a steel sheet for recent picture tube bands, which require higher reliability owing to the trend toward thinner-wall picture tubes.

The invention claimed is:

1. A high-strength, high-permeability steel sheet for picture tube band having a chemical composition consisting of, in mass percent, C: 0.005-0.010%, Si: 0.5-1.0%, Mn: 1.0-2.0%, P: 0.04-0.15%, S: not more than 0.02%, Al: 0.011-0.030%, N: not more than 0.004% and the balance of Fe and unavoidable impurities, and having a ferrite crystal grain diameter of 10-100 μm and a yield stress of 300 N/mm$^2$ or higher.

2. A high-strength, high-permeability steel sheet for picture tube band consisting of, in mass percent, C: 0.005-0.010%, Si: 0.5-1.0%, Mn: 1.0-2.0%, P: 0.04-0.15%, S: not more than 0.02%, Al: 0.011-0.030%, N: not more than 0.004% and the balance of Fe and unavoidable impurities, having a chemical composition satisfying the following Equation 1, and having a ferrite crystal grain diameter of 10-100 μm and a yield stress of 300 N/mm$^2$ or higher:

$$C \times Mn \times P \geqq 2.5 \times 10^{-4} \quad (1).$$

3. A steel sheet according to claim 1, whose specific permeability μ0.35 in a DC magnetic field of 0.35 Oe is 400 or higher.

4. A steel sheet according to claim 1, further comprising a Zn-system or Al-system plating layer on the surface thereof.

5. A method of producing a steel sheet set out in claim 1 characterized in that when production is carried out by, after hot rolling, conducting one or a plurality of cold rolling and annealing runs, (1) a coiling temperature after hot rolling is made 600-700° C., and (2) a final cold rolling reduction ratio and a final annealing temperature in a range of 750-900° C. are combined in accordance with a recrystallization property of the steel so that the ferrite crystal grain diameter after final annealing becomes 10-100 μm.

6. A method of producing a steel sheet set out in claim 1, further comprising:

a production process of, after hot rolling, conducting one or a plurality of cold rolling and annealing runs and conducting Zn-system or Al-system hot-dip plating inline in the cooling step of the final annealing run, or a production process of, after hot rolling, conducting one or a plurality of cold rolling and annealing runs, conducting Zn-system or Al-system hot-dip plating inline in the cooling step of the final annealing run, and thereafter conducting temper rolling of not greater than 1.5%, in which method, (1) a coiling temperature after hot rolling is made 600-700° C., and (2) a final cold rolling reduction ratio and a final annealing temperature in a range of 750-900° C. are combined in accordance with a recrystallization property of the steel so that the ferrite crystal grain diameter after plating becomes 10-100 μm.

7. A method of producing a steel sheet set out in claim 1, further comprising one production process among:

a production process of, after hot rolling, conducting one or a plurality of cold rolling and annealing runs and then conducting temper rolling at not greater than 1.5%, a production process of, after hot rolling, conducting one or a plurality of cold rolling and annealing runs and thereafter conducting Zn-system electroplating, a production process of, after hot rolling, conducting one or a plurality of cold rolling and annealing runs, then conducting temper rolling at not greater than 1.5% and thereafter conducting Zn-system electroplating, and a production process of, after hot rolling, conducting one or a plurality of cold rolling and annealing runs, thereafter conducting Zn-system electroplating, and further conducting temper rolling at not greater than 1.5%, in which method, (1) a coiling temperature after hot rolling is made 600-700° C., and (2) a final cold rolling reduction ratio and a final annealing temperature in a range of 750-900° C. are combined in accordance with a recrystallization property of the steel so that the ferrite crystal grain diameter after plating becomes 10-100 μm.

8. A method of producing a steel sheet set out in claim 2 characterized in that when production is carried out by, after hot rolling, conducting one or a plurality of cold rolling and annealing runs, (1) a coiling temperature after hot rolling is made 600-700° C., and (2) a final cold rolling reduction ratio and a final annealing temperature in a range of 750-900° C. are combined in accordance with a recrystallization property of the steel so that the ferrite crystal grain diameter after final annealing becomes 10-100 μm.

9. A method of producing a steel sheet set out in claim 2, further comprising:

a production process of, after hot rolling, conducting one or a plurality of cold rolling and annealing runs and conducting Zn-system or Al-system hot-dip plating inline in the cooling step of the final annealing run, or a production process of, after hot rolling, conducting one or a plurality of cold rolling and annealing runs, conducting Zn-system or Al-system hot-dip plating inline in the cooling step of the final annealing run, and thereafter conducting temper rolling of not greater than 1.5%, in which method, (1) a coiling temperature after hot rolling is made 600-700° C., and (2) a final cold rolling reduction ratio and a final annealing temperature in a range of 750-900° C. are combined in accordance with a recrystallization property of the steel so that the ferrite crystal grain diameter after plating becomes 10-100 μm.

10. A method of producing a steel sheet set out in claim 2, further comprising one production process among:

a production process of, after hot rolling, conducting one or a plurality of cold rolling and annealing runs and then conducting temper rolling at not greater than 1.5%, a production process of, after hot rolling, conducting one or a plurality of cold rolling and annealing runs and thereafter conducting Zn-system electroplating, a production process of, after hot rolling, conducting one or a plurality of cold rolling and annealing runs, then conducting temper rolling at not greater than 1.5% and thereafter conducting Zn-system electroplating, and a production process of, after hot rolling, conducting one or a plurality of cold rolling and annealing runs, thereafter conducting Zn-system electroplating, and further conducting temper rolling at not greater than 1.5%, in which method, (1) a coiling temperature after hot rolling is made 600-700° C., and (2) a final cold rolling reduction ratio and a final annealing temperature in a range of 750-900° C. are combined in accordance with a recrystallization property of the steel so that the ferrite crystal grain diameter after plating becomes 10-100 μm.

* * * * *